US007698902B2

(12) United States Patent
Kang et al.

(10) Patent No.: US 7,698,902 B2
(45) Date of Patent: Apr. 20, 2010

(54) DEFROST OPERATING METHOD FOR REFRIGERATOR

(75) Inventors: Sung-Hee Kang, Changwon-Shi (KR); Deok-Hyun Youn, Anyang-Shi (KR); Su-Won Lee, Changwon-Shi (KR); Jong-Min Shin, Busan (KR); Jung-Wook Bae, Jinhae-Shi (KR)

(73) Assignee: LG Electronics Inc., Seoul (KR)

( * ) Notice: Subject to any disclaimer, the term of this patent is extended or adjusted under 35 U.S.C. 154(b) by 404 days.

(21) Appl. No.: 11/797,312

(22) Filed: May 2, 2007

(65) Prior Publication Data

US 2007/0283706 A1 Dec. 13, 2007

Related U.S. Application Data

(63) Continuation of application No. PCT/KR2004/002796, filed on Nov. 2, 2004.

(51) Int. Cl.
*F25D 21/06* (2006.01)

(52) U.S. Cl. ..... 62/156; 62/155

(58) Field of Classification Search ..... 62/151, 62/153, 154, 155, 156
See application file for complete search history.

(56) References Cited

U.S. PATENT DOCUMENTS 5,809,789 A * 9/1998 Baker et al. ..... 62/81
6,131,400 A 10/2000 Seok et al.
2004/0050079 A1* 3/2004 Holmes et al. ..... 62/187

FOREIGN PATENT DOCUMENTS

| | | | |
|---|---|---|---|
| DE | 296 06 407 U1 | | 9/1997 |
| JP | 9-318231 A | | 12/1997 |
| JP | 09318231 A | * | 12/1997 |
| JP | 10-111064 A | | 4/1998 |
| JP | 2004076995 A | * | 3/2004 |
| KR | 10-0213718 B1 | | 5/1999 |

* cited by examiner

*Primary Examiner*—Chen-Wen Jiang
(74) *Attorney, Agent, or Firm*—Birch, Stewart, Kolasch & Birch, LLP

(57) ABSTRACT

The present invention discloses a defrost operating method for a refrigerator which performs a defrost operation by controlling operations of a compressor and a fan on the basis of a continuous operation time of the compressor and surface temperatures of evaporators to prevent frost from being formed on the evaporators, when cool air is generated in a freezing chamber and a refrigerating chamber by circulating refrigerants through a refrigeration cycle built in a refrigerator main body and forcibly circulated bX rotating the fan. The defrost operating method for the refrigerator can omit a general defrosting heater by performing the defrost operation by using the compressor and the fan. In addition, the defrost operating method for the refrigerator improves heat exchange efficiency and reduces power consumption by efficiently performing the defrost operation.

12 Claims, 8 Drawing Sheets

DEFROST OPERATING METHOD FOR REFRIGERATOR

This application is a Continuation of copending PCT International Application No. PCT/KR2004/002796 filed on Nov. 2, 2004, which designated the United States, and on which priority is claimed under 35 U.S.C. §120. The entire contents of the above document is hereby incorporated by reference.

TECHNICAL FIELD

The present invention relates to a defrost operating method for a refrigerator which can perform a defrost operation by controlling operations of a compressor and a fan on the basis of a continuous operation time of the compressor and surface temperatures of evaporators.

BACKGROUND ART

In general, a refrigerator prevents deterioration and reduction of freshness of foods, by generating cool air by exchanging heat with cold refrigerants passing through a refrigeration cycle, and freezing or maintaining the foods at a low temperature by circulating the cool air in a freezing chamber and a refrigerating chamber. Therefore, the refrigerator stores various kinds of foods for an extended period of time.

Normally, the refrigerators are classified into direct cooling type refrigerators and indirect cooling type refrigerators. In the direct cooling type refrigerator, evaporators are installed on inner walls of a freezing chamber and a refrigerating chamber, and cool air generated at the adjacent parts to the evaporators in the freezing chamber and the refrigerating chamber is naturally convected to cool the freezing chamber and the refrigerating chamber. Conversely, in the indirect cooling type refrigerator, an evaporator is installed on an inner wall of a freezing chamber, a fan is installed on a cool air circulation passage, and cool air generated on the cool air circulation passage on which the evaporator has been installed is forcibly blown by the fan to cool the freezing chamber and the refrigerating chamber.

Moisture generated from foods stored in the refrigerator inside or moisture of the open air sucked into the refrigerator inside due to opening of doors generates frost on the surfaces of the evaporators. The frost formed on the surfaces of the evaporators reduces heat exchange efficiency between the air inside the refrigerator and the evaporators. A temperature deviation seriously increases in each position of the refrigerating chamber having a relatively higher temperature than the freezing chamber. Therefore, a defrost operation is essential in the refrigerating chamber.

The compressor is stopped for a predetermined standstill time to defrost the conventional direct cooling type refrigerator. As the using time of the refrigerator increases, the frost formed in the refrigerator inside is grown to cover the whole surface of the refrigerator inside. Accordingly, the user must manually defrost the refrigerator.

In addition, a defrosting heater mounted at the lower portion of the evaporator is operated to defrost the conventional indirect cooling type refrigerator, thereby rapidly performing the defrost operation. However, the defrosting heater increases manufacturing and production expenses and power consumption. Also, the defrosting heater sharply increases a temperature of the adjacent parts. As a result, the refrigerator inside temperatures are not uniformly maintained, and cooling performance is deteriorated.

DISCLOSURE OF THE INVENTION

The present invention is achieved to solve the above problems. An object of the present invention is to provide a defrost operating method for a refrigerator which can efficiently perform a defrost operation by controlling operations of a compressor and a fan without using a defrosting heater.

Another object of the present invention is to provide a defrost operating method for a refrigerator which can precisely perform a defrost operation by judging formation of frost on surfaces of evaporators on the basis of opening/closing of refrigerator doors, refrigerator inside temperatures and a continuous operation time of a compressor.

In order to achieve the above-described objects of the invention, there is provided a defrost operating method for a refrigerator, including: while cool air is generated in the refrigerator by circulating refrigerants along a refrigeration cycle built in an inner wall of a refrigerator main body, and forcibly circulated by rotating a fan, a first step for calculating a continuous operation time of a compressor by accumulating an operation time of the compressor, and measuring surface temperatures of evaporators; and a second step for performing a defrost operation by controlling operations of the compressor and the fan on the basis of the continuous operation time of the compressor and the surface temperatures of the evaporators calculated in the first step.

Here, the first step includes: a first process for judging opening/closing of refrigerator doors for opening/closing the refrigerator main body; when the refrigerator doors are closed in the first process, a second process for comparing refrigerator inside temperatures with a set refrigerator inside temperature; and when the refrigerator inside temperatures are equal to or higher than the set refrigerator inside temperature in the second process, a third process for calculating the continuous operation time of the compressor.

The defrost operating method for the refrigerator further includes, when the refrigerator doors are opened in the first process, a process for stopping the fan. Preferably, even though the fan is stopped in the first process, an open time of the refrigerator doors is accumulated, when a continuous open time of the refrigerator doors is equal to or longer than a set continuous open time, the compressor is stopped, and when the continuous open time of the refrigerator doors is shorter than the set continuous open time, opening/closing of the refrigerator doors is judged again.

The defrost operating method for the refrigerator further includes, when the refrigerator inside temperatures are lower than the set refrigerator inside temperature in the second process, a process for stopping the compressor. Preferably, even though the compressor is stopped in the second process, when the surface temperatures of the evaporators are equal to or lower then the set surface temperature, the defrost operation is performed in a state where the fan is operated, and even though the compressor is stopped, when the surface temperatures of the evaporators exceed the set surface temperature, the fan is stopped.

Preferably, a rotary speed of the fan is inversely proportional to variations of the surface temperatures of the evaporators. More preferably, the rotary speed of the fan is higher in the defrost operation than in the cooling operation.

On the other hand, the second step Includes, when the continuous operation time of the compressor is equal to or longer than the set continuous operation time, a process for performing the defrost operation by stopping the compressor and operating the fan as it is. In a state where the compressor is stopped, the process for operating the fan is performed within a set time. Preferably, the rotary speed of the fan is higher in the defrost operation than in the cooling operation.

Preferably, the second step includes, when the continuous operation time of the compressor is shorter than the set continuous operation time, a process for operating the compressor as it is.

While the compressor is operated as it is in the second step, when the surface temperatures of the evaporators are equal to or lower than the set surface temperature, the defrost operation is performed in a state where the fan is operated. The rotary speed of the fan is inversely proportional to variations of the surface temperatures of the evaporators. More preferably, the rotary speed of the fan is higher in the defrost operation than in the cooling operation.

While the compressor is operated as it is in the second step, when the surface temperatures of the evaporators exceed the set surface temperature, the fan is stopped.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

A defrost operating method for a refrigerator in accordance with the preferred embodiments of the present invention will now be described in detail with reference to the accompanying drawings.

Figure 1:
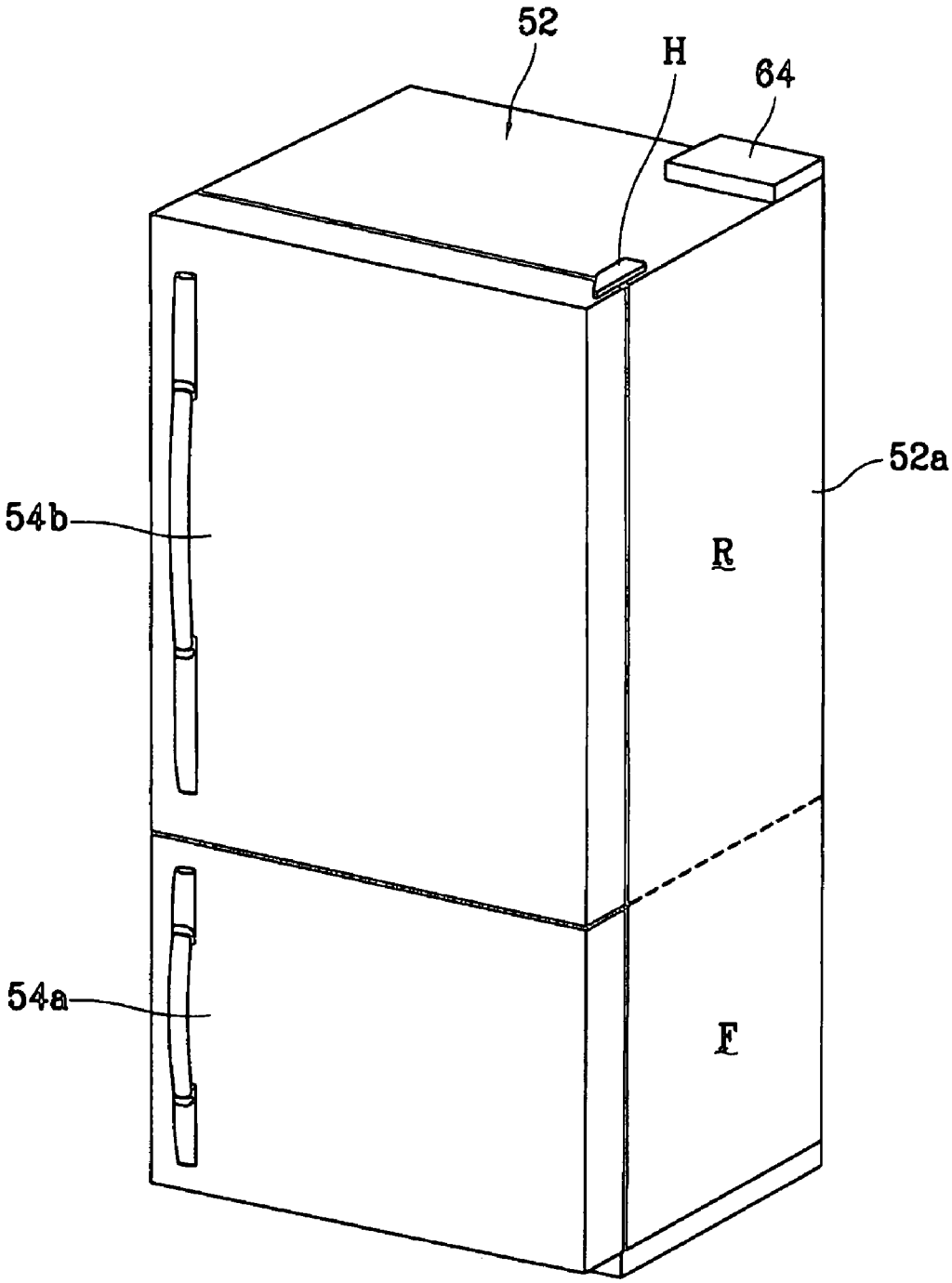
FIG. 1 is a perspective view illustrating a refrigerator to which a defrost operating method is applied in accordance with the present invention.
Figure 2:
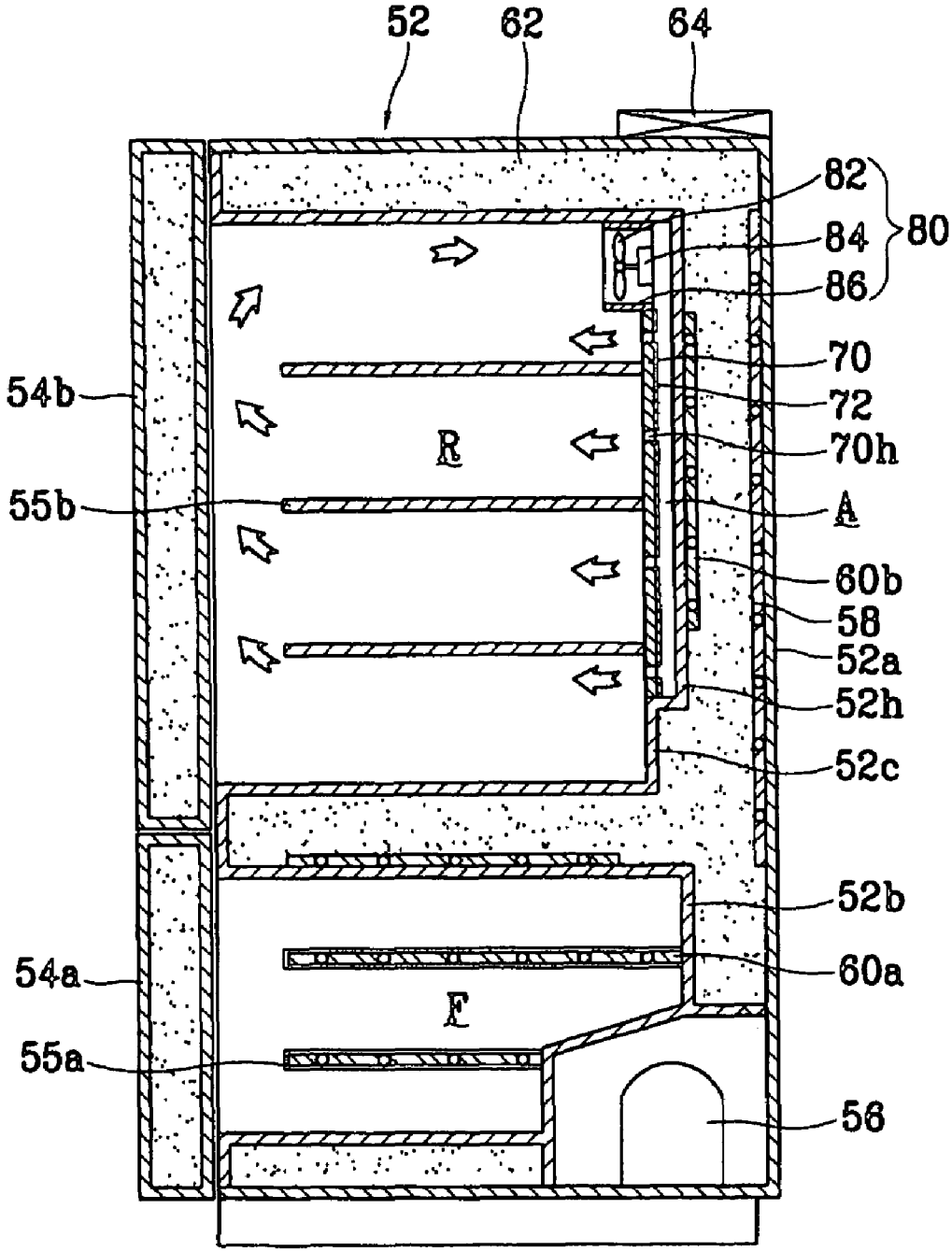
FIG. 2 is a side-sectional view illustrating the refrigerator of FIG. 1.
Figure 3:
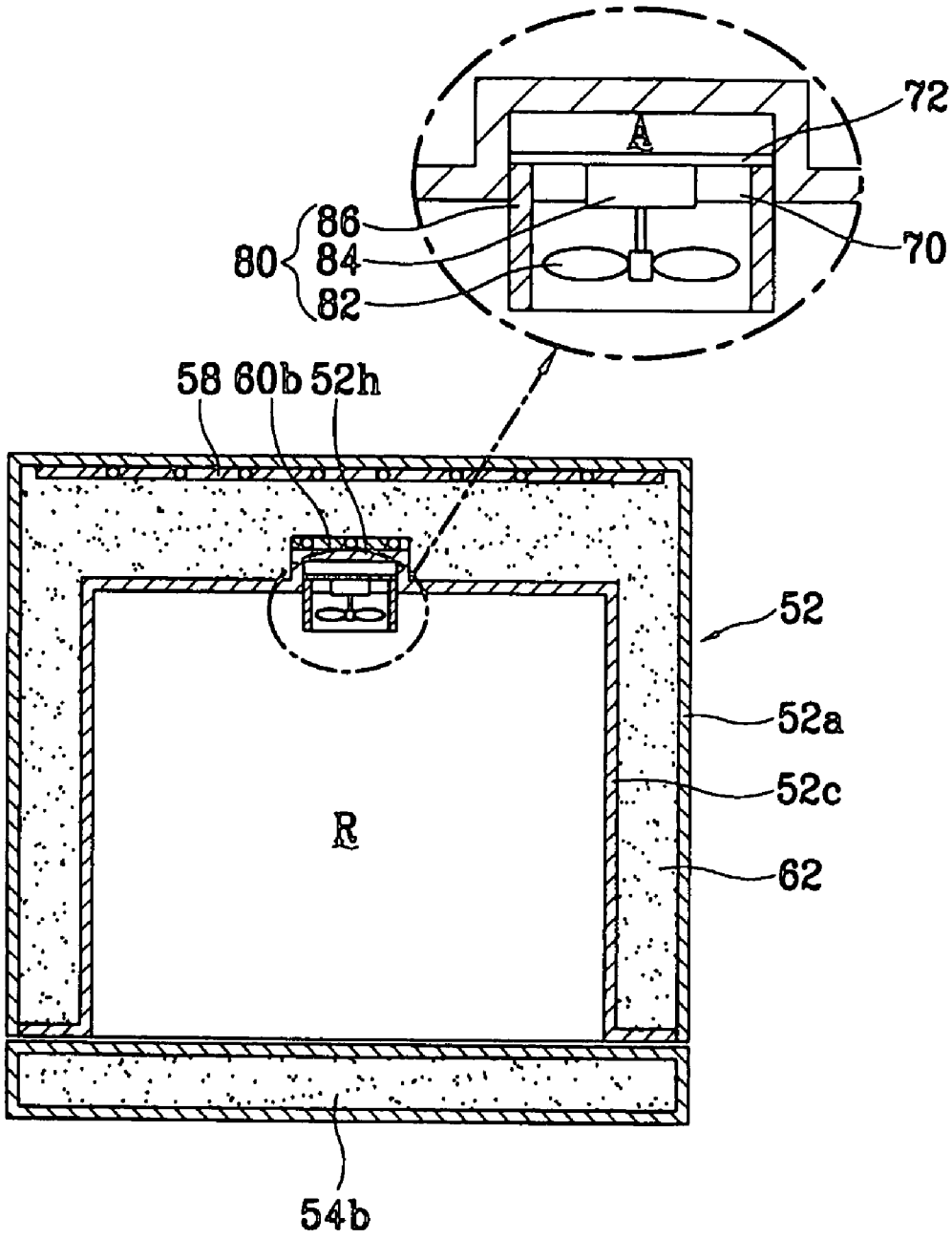
FIG. 3 is a plane-sectional view illustrating the refrigerator of FIG. 1.
Figure 4:
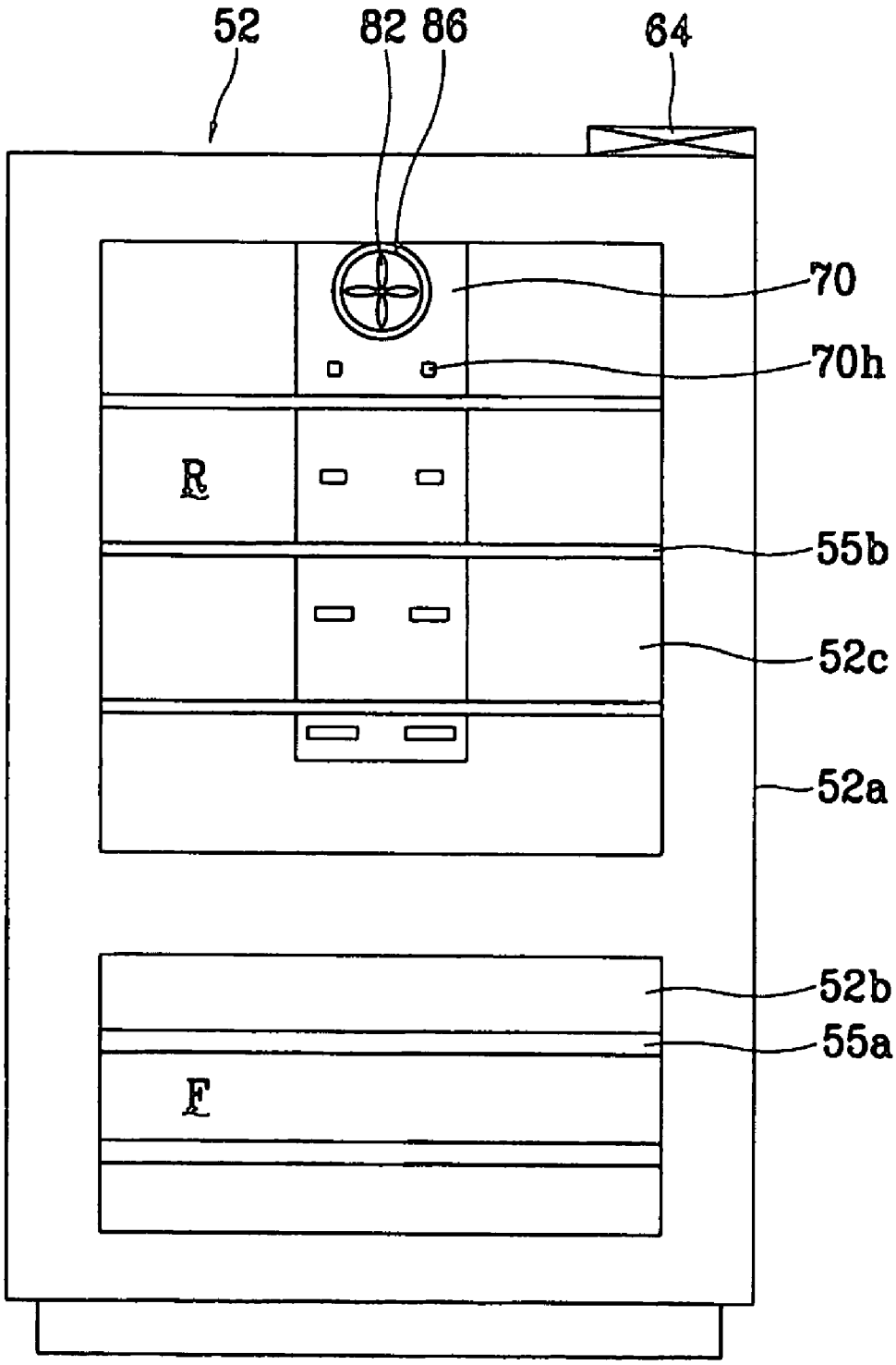
FIG. 4 is a front view illustrating a refrigerator main body of FIG. 1.

FIGS. 1 to 3 are a perspective view, a side-sectional view and a plane-sectional view respectively illustrating a refrigerator to which a defrost operating method is applied in accordance with the present invention, and FIG. 4 is a front view illustrating a refrigerator main body of FIG. 1.

Referring to FIGS. 1 to 4, in the refrigerator, a freezing chamber F and a refrigerating chamber R are formed at the lower and upper portions of a refrigerator main body 52 having its front surface opened, a freezing chamber door 54*a* and a refrigerating chamber door 54*b* are hinge-coupled (H) to the front surface of the refrigerator main body 52, and a refrigeration cycle including evaporators 60*a* and 60*b* is built in an inner wall of the refrigerator main body 52. Here, the freezing chamber F is cooled by direct cooling by naturally convecting cool air, and the refrigerating chamber R is cooled by indirect cooling by forcibly blowing cool air.

In detail, in a state where various components are built in between an outer casing 52*a* composing an outer appearance of the refrigerator main body 52 and inner casings 52*b* and 52*c*, an insulation material 62 is foamed, and the freezing chamber F and the refrigerating chamber R are installed inside the inner casings 52*b* and 52*c*.

A cool air circulation groove 52*h* is formed long in the up/down direction on the refrigerating chamber side inner casing 52*c*, for forming a refrigerant circulation passage A.

The evaporators 60*a* and 60*b* are formed by installing two plates having refrigerant tube grooves to overlap with each other. The evaporators 60*a* and 60*b* include a freezing chamber side evaporator 60*a* and a refrigerating chamber side evaporator 60*b* installed respectively at the freezing chamber F and the refrigerating chamber R. The freezing chamber side evaporator 60*a* and the refrigerating chamber side evaporator 60*b* are connected to each other so that refrigerants can flow therethrough.

The freezing chamber side evaporator 60*a* is built in a shelf allowing the user to put foods in the freezing chamber F and partitioning housing spaces, for directly cooling the freezing chamber F, and the refrigerating chamber side evaporator 60*b* is built in to be closely adhered to the inner wall of the refrigerating chamber side inner casing 52*c*. Preferably, the refrigerating chamber side evaporator 60*b* is adhered merely to the inner wall of the cool air circulation groove 52*h* of the refrigerating chamber R.

The evaporators 60*a* and 60*b* are connected to a compressor 56, a condenser 58, an expansion means (not shown) such as a capillary tube or an electronic expansion valve, for composing the refrigeration cycle by refrigerant circulation.

Temperature sensors (not shown) are built in one-side portions of the evaporators 60*a* and 60*b*. Each of the temperature sensors is connected to a control unit 64 for controlling operations of various components. The control unit 64 controls the operation of the compressor 56 according to temperature signals from the temperature sensors.

A duct 70 is mounted on the cool air circulation groove 52*h* to selectively form the refrigerant circulation passage A, and an air blowing device 80 is installed to inject cool air from the upper to lower portion of the refrigerating chamber R. The air blowing device 80 is also connected to and controlled by the control unit 64.

Since the duct 70 is mounted on the cool air circulation groove 52*h*, the duct 70 does not interfere with a shelf 55*b* allowing the user to put foods in the refrigerating chamber R.

Here, the duct 70 is formed in a plate shape having a suction hole at its upper end, and having a plurality of refrigerant distribution holes 70*h* at the lower portion of the suction hole at predetermined intervals. Preferably, the refrigerant distribution holes 70*h* are increased in size from the upper to lower end of the duct 70, so that the cool air can be discharged from each position at the same flow amount even if the cool air flows along the refrigerant circulation passage A and causes a flow resistance.

In addition, when the cool air continuously flows along the refrigerant circulation passage A, the cool air actively exchanges heat with the refrigerating chamber side evaporator 60*b*, and thus has a low temperature state. While the flow amount of the cool air is reduced from the upper to lower end of the duct 70, the cool air maintains a lower temperature state. Accordingly, the same size of refrigerant distribution holes 70*h* can also obtain the same cooling effects in each position.

Both ends of the duct 70 are inserted into the cool air circulation groove 52*h*. In a state where the duct 70 is mounted on the cool air circulation groove 52*h*, the front surface of the duct 70 forms the same plane surface with the inner wall of the refrigerating chamber side inner casing 52*c*, thereby preventing an inside capacity of the refrigerating chamber R from becoming smaller than that of the conventional direct cooling type refrigerating chamber.

A predetermined thickness of insulation material 72 is adhered to the rear surface of the duct 70. Even though frost or condensed water is formed on the surface of the cool air circulation groove 52*h* on which the refrigerating chamber side evaporator 60*b* is installed, the frost or condensed water is covered by the duct 70. Since the frost or condensed water is not formed on the outside surface of the duct 70 facing the refrigerating chamber R by insulation effects, the cooling operation is sanitarily performed.

Moreover, a drain pipe (not shown) for externally guiding the condensed water even if the frost formed on the surface of the cool air circulation groove 52*h* is molten and runs down, is connected to the lower end of the duct 70, and a drain fan (not shown) for collecting the condensed water is installed at the end of the drain pipe. Preferably, the drain fan can be taken out.

The air blowing device 80 includes a blast fan 82 for blowing the cool air circulated in the refrigerating chamber R to the refrigerant circulation passage A, a motor 84 for driving the blast fan 82, and a fan housing 86 in which the blast fan 82 and the motor 84 are installed. Here, the fan housing 86 is mounted on the suction hole of the duct 70, and the motor 84 is connected to and controlled by the control unit 64.

Preferably, the blast fan 82 is an axial fan for blowing cool air in the axial direction. The blast fan 82 guides the cool air a long the refrigerant circulation passage A formed by the fan housing 86, the duct 70 and the cool air circulation groove 52*h*.

Preferably, an object is disposed at the front portion of the fan housing 86 with a predetermined gap for minimizing a suction flow resistance. More preferably, the gap is decided according to a diameter of the blast fan 82.

The control unit 64 controls operations of other components in addition to the compressor 56, the blast fan 82 and the motor 84. When the control unit 64 externally receives a set freezing temperature $Tf_0$ and a set refrigerating temperature $Tr_0$, the control unit 64 controls each component so that temperatures measured by the temperature sensors (not shown) installed in the freezing chamber F and the refrigerating chamber R can reach the set freezing temperature range and the set refrigerating temperature range.

Figure 5:
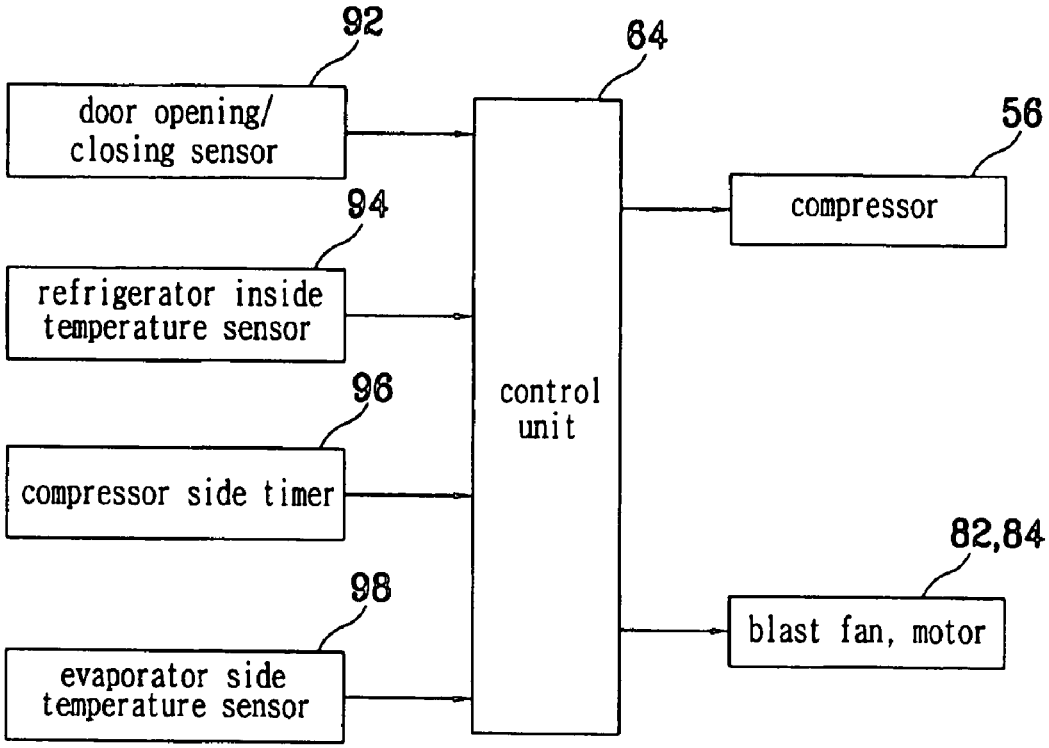
FIG. 5 is a block diagram illustrating a defrost operating system for a refrigerator in accordance with the present invention.
Figure 6:
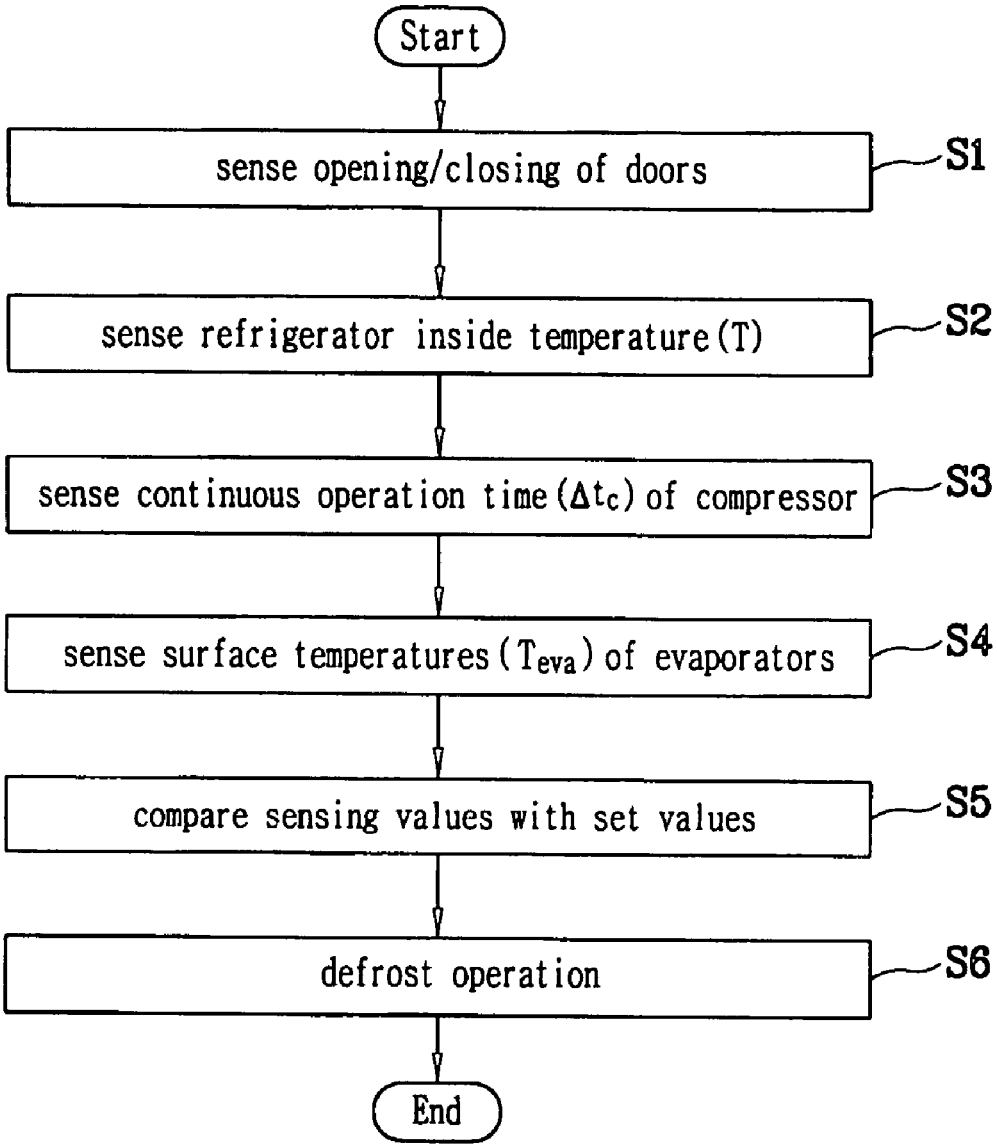
FIG. 6 is a flowchart showing sequential steps of a defrost operating method for a refrigerator in accordance with the present invention.

FIG. 5 is a block diagram illustrating a defrost operating system for a refrigerator in accordance with the present invention, and FIG. 6 is a flowchart showing sequential steps of a defrost operating method for a refrigerator in accordance with the present invention.

In detail, as shown in FIGS. 5 and 6, the control unit 64 is connected respectively to door opening/closing sensors 92 installed between the refrigerator main body 52 and the freezing chamber door 54*a* and the refrigerating chamber door 54*b*, for sensing opening/closing of the freezing chamber door 54*a* and the refrigerating chamber door 54*b*, respectively, refrigerator inside temperature sensors 94 for sensing temperatures of the freezing chamber F and the refrigerating chamber R, respectively, a compressor side timer 96 for measuring an operation time of the compressor 56, and evaporator side temperature sensors 98 for sensing surface temperatures of the evaporators 60*a* and 60*b*, respectively, and receives sensing values from each sensor (refer to S1 to S4).

The control unit 64 accumulates an operation time t of the compressor 56 sensed by the timer 96. When a continuous operation time $\Delta t_c$ of the compressor 56 is equal to or longer than a set continuous operation time $\Delta t_{c_s}$, the timer 96 is reset to re-count the operation time t of the compressor 56.

In addition, the control unit 64 decides opening/closing of the doors 54*a* and 54*b*, compares the sensing values of each sensor, namely, the refrigerator inside temperatures T, the continuous operation time $\Delta t_c$ of the compressor 56 and the surface temperatures $T_{eva}$ of the evaporators 60*a* and 60*b* with the previously-stored set refrigerator inside temperature $T_s$, set continuous operation time $\Delta t_{c_s}$ and set surface temperature $T_{eva_s}$, and controls the operations of the compressor 56, the blast fan 82 and the motor 84 according to the comparison results, thereby performing the normal operation and the defrost operation (refer to S4 and S5).

Especially, in order to precisely decide the defrost timing, the control unit 64 sequentially senses opening/closing of the doors 54*a* and 54*b*, the refrigerator inside temperatures T, the continuous operation time $\Delta t_c$ of the compressor 56 and the surface temperatures $T_{eva}$ of the evaporators 60*a* and 60*b*, compares the sensing values with the set values, and performs different defrost operations according to the comparison results.

When performing the defrost operation, the aforementioned refrigerator and the direct cooling type refrigerator defrost the surfaces of the evaporators by indirect heat exchange by sending air to the adjacent parts to the evaporators, and the indirect cooling type refrigerator defrosts the surfaces of the evaporators' by direct heat exchange by directly sending the air to the evaporators.

Figure 7:
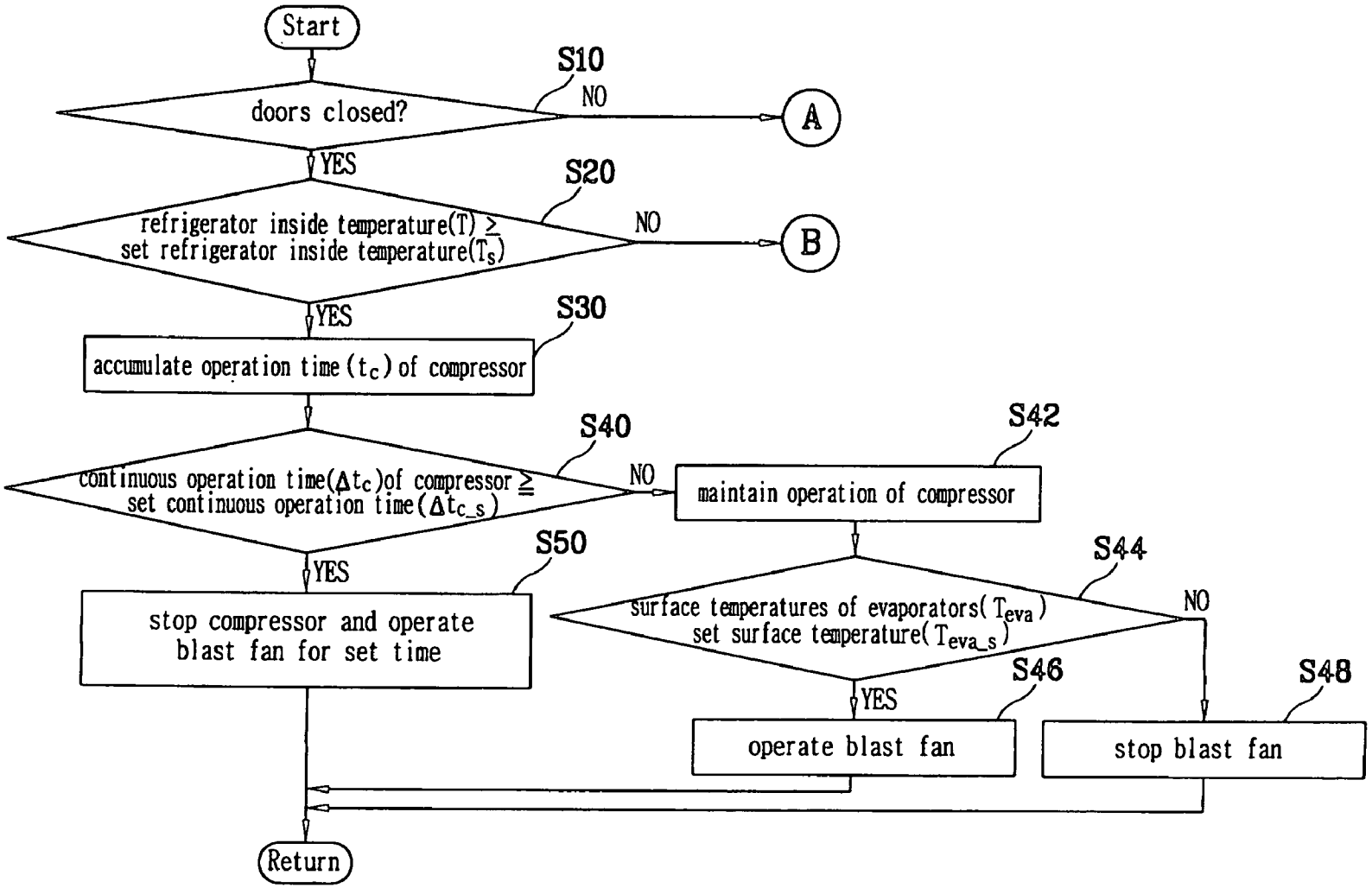
FIGS. 7 to 9 are detailed flowcharts showing sequential steps of the defrost operating method for the refrigerator in accordance with the present invention.
Figure 8:
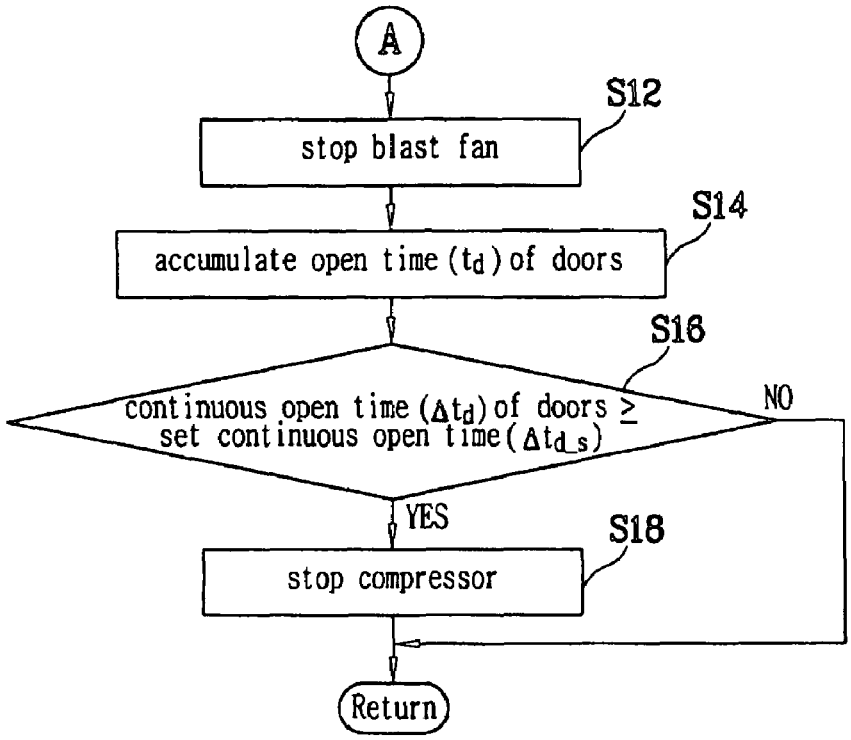
Figure 9:
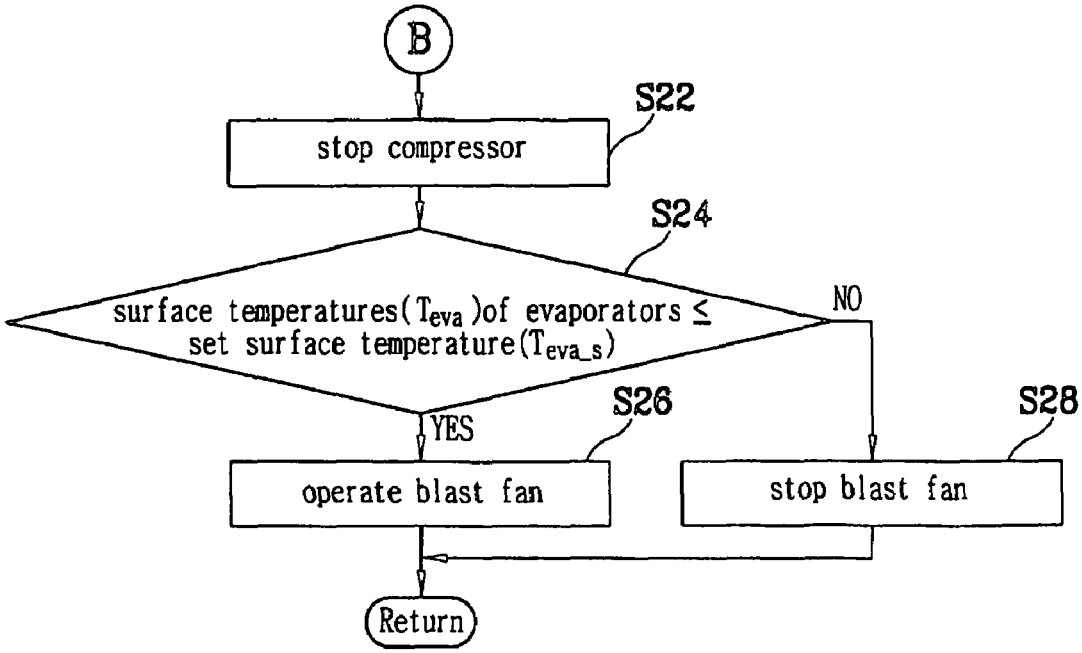

FIGS. 7 to 9 are detailed flowcharts showing sequential steps of the defrost operating method for the refrigerator in accordance with the present invention.

The defrost operating method applied to the above-described refrigerator will now be described in detail. As shown in FIG. 7, in a first step, opening/closing of the doors 54*a* and 54*b* is judged. When the doors 54*a* and 54*b* are closed, the refrigerator inside temperatures T are compared with the set refrigerator inside temperature $T_s$ (refer to S10 and S20).

Here, the control unit 64 senses opening/closing of the freezing chamber door 54*a* and the refrigerating chamber door 54*b* by the door opening/closing sensors 92. In the case of the refrigerator in which the freezing chamber F and the refrigerating chamber R are linked to each other, when any of the freezing chamber door 54*a* and the refrigerating chamber door 54*b* is opened, the control unit 64 judges by the opening state. In the case of the refrigerator in which the freezing chamber F and the refrigerating chamber R are partitioned, the control unit 64 judges the opening or closing state according to opening/closing of the refrigerating chamber door 54*b* installed on the refrigerating chamber R having a relatively high temperature.

If the doors 54*a* and 54*b* are closed, the refrigerator inside temperatures T measured by the temperature sensors 94 installed in the freezing chamber F and the refrigerating chamber R are inputted to the control unit 64. The control unit 64 compares the refrigerator inside temperatures T with the set refrigerator inside temperature $T_s$ decided by freezing and refrigerating temperatures inputted by the user.

In a second step, when the refrigerator inside temperatures T are equal to or higher than the set refrigerator inside temperature $T_s$ in the first step, the operation time $t_c$ of the compressor 56 is accumulated, and the continuous operation time $\Delta t_c$ of the compressor 56 is compared with the set continuous operation time $\Delta t_{c_s}$ (refer to S30 and S40).

The control unit 64 calculates the continuous operation time $\Delta t_c$ of the compressor 56 by accumulating the operation time $t_c$ of the compressor 56 measured by the timer 96. When the continuous operation time $\Delta t_c$ of the compressor 56 is equal to or longer than the set continuous operation time $\Delta t_{c_s}$, the control unit 64 resets the continuous operation time $\Delta t_c$ of the compressor 56 and re-accumulates the operation time $t_c$ of the compressor 56.

When the compressor 56 is operated over the set continuous operation time $\Delta t_{c_s}$, the compressor 56 is overheated, and the refrigerants circulated in the evaporators 60*a* and 60*b* of the refrigeration cycle maintain an excessively low temperature state, so that moisture of the air may easily generate the frost in the refrigerator inside. In order to solve the foregoing problems, when the continuous operation time $\Delta t_c$ of the compressor 56 exceeds the set continuous operation time $\Delta t_{c_s}$, the control unit 64 preferably stops the compressor 56. More preferably, the set continuous operation time $\Delta t_{c_s}$ is set to be about 120 minutes on the basis of experimental results.

In a third step, when the continuous operation time $\Delta t_c$ of the compressor 56 is equal to or longer than the set continuous operation time $\Delta t_{c_s}$, in the second step, in a state where the compressor 56 is stopped for a set time $t_s$, the blast fan 82 is operated to perform the defrost operation (refer to S50).

Since the refrigerator inside temperatures T must be maintained over the set refrigerator inside temperature $T_s$, the cooling operation is performed by operating the compressor 56 and the blast fan 82. However, even if the refrigerator inside temperatures T are equal to or higher than the set refrigerator inside temperature $T_s$, the control unit 64 decides that the compressor 56 has been overheated due to excessive operations or the frost has been formed in the refrigerator, thereby performing the defrost operation.

Here, the defrost operation forcibly stops the compressor 56 and drives the blast fan 82 as it is. Therefore, the relatively high temperature air directly passes through the evaporators 60*a* and 60*b* or passes through the adjacent parts thereof, to melt the frost formed on the surfaces of the evaporators 60*a* and 60*b*. Preferably, the blast fan 82 is rotated at a rotary speed higher than a rotary speed in the cooling operation.

If the defrost operation is performed for a long time, the refrigerator inside temperatures T may excessively increase. Accordingly, the defrost operation is performed within the set time t. Preferably, the set time $t_s$ is about 25 minutes.

However, when the continuous operation time $\Delta t_c$ of the compressor 56 is shorter than the set continuous operation time $\Delta t_{c_s}$ in the second step, In a state where the compressor 56 is operated, the surface temperatures $T_{eva}$ of the evaporators 60*a* and 60*b* are compared with the set surface temperature $T_{eva_s}$ to decide whether the frost is formed on the evaporators 60*a* and 60*b* (refer to S42 and S44).

The continuous operation time $\Delta t_c$ of the compressor 56 decides whether the frost is formed in the refrigerator inside, and the surface temperatures $T_{eva}$ of the evaporators 60*a* and 60*b* decide whether the frost is formed on the evaporators 60*a* and 60*b*, thereby precisely performing the defrost operation.

Preferably, the set surface temperature $T_{eva_s}$ is set to be 1° C. in the control unit 64 to defrost the surfaces of the evaporators 60*a* and 60*b*.

When the surface temperatures $T_{eva}$ of the evaporators 60*a* and 60*b* are equal to or lower than the set surface temperature $T_{eva_s}$, the control unit 64 decides that the frost has been formed on the surfaces of the evaporators 60*a* and 60*b*, and circulates the relative high temperature air by operating the blast fan 82 in a state where the compressor 56 is operated, thereby defrosting the adjacent parts to the evaporators 60*a* and 60*b* (refer to S46).

The rotary speed of the blast fan 82 can be controlled according to variations of the surface temperatures $T_{eva}$ of the evaporators 60*a* and 60*b*. Preferably, the rotary speed of the blast fan 82 is inversely proportional to the variations of the surface temperatures $T_{eva}$ of the evaporators 60*a* and 60*b*, and higher in the defrost operation than in the cooling operation.

However, when the surface temperatures $T_{eva}$ of the evaporators 60*a* and 60*b* exceed the set surface temperature $T_{eva_s}$, the control unit 64 decides that the frost has not been formed on the surfaces of the evaporators 60*a* and 60*b* or has been molten thereon, and stops the blast fan 82 (refer to S48).

Preferably, the compressor 56 is operated as it is, so that the evaporators 60*a* and 60*b* can maintain a sufficiently low temperature state to exchange heat with the air inside the refrigerator.

On the other hand, when the doors 54*a* and 54*b* are opened in the first step, as shown in FIG. 8, the blast fan 82 is stopped, and a continuous open time $\Delta t_d$ of the doors 54*a* and 54*b* is calculated by accumulating an open time $t_d$ of the doors 54*a* and 54*b* (refer to S12 and S14).

When the control unit 64 decides that the freezing chamber door 54*a* and the refrigerating chamber door 54*b* have been opened from the refrigerator main body 52, the control unit 64 preferably stops the blast fan 82 to prevent the cool air from being externally discharged from the freezing chamber F and the refrigerating chamber R.

When the continuous open time $\Delta t_d$ of the doors 54*a* and 54*b* is equal to or longer than a set continuous open time $\Delta t_{d_s}$, the control unit 64 stops the compressor 56 and re-senses opening/closing of the doors 54*a* and 54*b*. Conversely, when the continuous open time $\Delta t_d$ of the doors 54*a* and 54*b* is shorter than the set continuous open time $\Delta t_{d_s}$ the control unit 64 directly senses opening/closing of the doors 54*a* and 54*b* (refer to S16 and S18).

As the continuous open time $\Delta t_d$ of the doors 54*a* and 54*b*, namely, the time of opening the freezing chamber door 54*a* and the refrigerating chamber door 54*b* from the refrigerator main body 52 increases, load of the freezing chamber F and the refrigerating chamber R increases, power consumption increases, and outdoor air is sucked into the refrigerator to generate the frost at the adjacent parts to the evaporators 60*a* and 60*b*. To solve the foregoing problem, the control unit 64 forcibly stops the compressor 56.

On the other hand, when the doors 54*a* and 54*b* are closed and the refrigerator inside temperatures T are lower than the set refrigerator inside temperature $T_s$ in the first step, as depicted in FIG. 9, the control unit 64 decides that the load inside the refrigerator has been completely settled, stops the compressor 56, and compares the surface temperatures $T_{eva}$ of the evaporators 60*a* and 60*b* with the set surface temperature $T_{eva_s}$ to decide whether the frost is formed on the evaporators 60*a* and 60*b* (refer to S22 and S24).

Identically, the set surface temperature $T_{eva_s}$ is preferably set to be 1° C. in the control unit 64 to defrost the surfaces of the evaporators 60*a* and 60*b*.

When the surface temperatures $T_{eva}$ of the evaporators 60*a* and 60*b* are equal to or lower than the set surface temperature $T_{eva_s}$, the control unit 64 decides that the frost has been formed on the surfaces of the evaporators 60*a* and 60*b*, and circulates the relatively high temperature air by operating the blast fan 82 in a state where the compressor 56 is stopped, thereby defrosting the adjacent parts to the evaporators 60*a* and 60*b*. Conversely, when the surface temperatures $T_{eva}$ of the evaporators 60*a* and 60*b* exceed the set surface temperature $T_{eva_s}$, the control unit 64 decides that the frost has not been formed on the surfaces of the evaporators 60*a* and 60*b* or has been molten thereon, and stops the blast fan 82 (refer to S26 and S28).

Preferably, the rotary speed of the blast fan 82 is inversely proportional to the variations of the surface temperatures $T_{eva}$ of the evaporators 60*a* and 60*b*, and higher in the defrost operation than in the cooling operation.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A defrost operating method for a refrigerator, comprising:

while cool air is generated in the refrigerator inside by circulating refrigerants along a refrigeration cycle built in an inner wall of a refrigerator main body, and forcibly circulated by rotating a fan, a first step for calculating a continuous operation time of a compressor by accumulating an operation time of the compressor, and measuring surface temperatures of evaporators; and a second step for performing a defrost operation by controlling operations of the compressor and the fan on the basis of the continuous operation time of the compressor and the surface temperatures of the evaporators calculated in the first step, wherein the first step comprises:

a first process for judging opening/closing of refrigerator doors for opening/closing the refrigerator main body;

when the refrigerator doors are closed in the first process, a second process for comparing refrigerator inside temperatures with a set refrigerator inside temperature; and when the refrigerator inside temperatures are equal to or higher than the set refrigerator inside temperature in the second process, a third process for calculating the continuous operation time of the compressor and when the refrigerator inside temperatures are lower than the set refrigerator inside temperature in the second process, a process for stopping the compressor, wherein, even though the compressor is stopped, when the surface temperatures of the evaporators are equal to or lower than the set surface temperature, the defrost operation is performed in a state where the fan is operated, and wherein a rotating speed of the fan is inversely proportional to variations of the surface temperatures of the evaporators.

2. The method of claim 1, further comprising, when the refrigerator doors are opened in the first process, a process for stopping the fan.

3. The method of claim 2, wherein, even though the fan is stopped in the first process, an open time of the refrigerator doors is accumulated, and when a continuous open time of the refrigerator doors is equal to or longer than a set continuous open time, the compressor is stopped.

4. The method of claim 3, wherein, even though the fan is stopped in the first process, the an open time of the refrigerator doors is accumulated, and when the continuous open time of the refrigerator doors is shorter than the set continuous open time, opening/closing of the refrigerator doors is judged again.

5. The method of claim 1, wherein the rotating speed of the fan is higher in the defrost operation than in the cooling operation.

6. The method of claim 1, wherein, even though the compressor is stopped, when the surface temperatures of the evaporators exceed the set surface temperature, the fan is stopped.

7. A defrost operating method for a refrigerator, comprising:

while cool air is generated in the refrigerator inside by circulating refrigerants along a refrigeration cycle built in an inner wall of a refrigerator main body, and forcibly circulated by rotating a fan, a first step for calculating a continuous operation time of a compressor by accumulating an operation time of the compressor, and measuring surface temperatures of evaporators; and a second step for performing a defrost operation by controlling operations of the compressor and the fan on the basis of the continuous operation time of the compressor and the surface temperatures of the evaporators calculated in the first step, wherein the second step comprises, when the continuous operation time of the compressor is equal to or longer than the set continuous operation time, a process for performing the defrost operation by stopping the compressor and operating the fan as it is, wherein the rotating speed of the fan is higher in the defrost operation than in the cooling operation.

8. The method of claim 7, wherein, in a state where the compressor is stopped, the process for operating the fan is performed within a set time.

9. The method of claim 7, wherein the second step comprises, when the continuous operation time of the compressor is shorter than the set continuous operation time, a process for operating the compressor as it is.

10. The method of claim 9, wherein, while the compressor is operated as it is in the second step, when the surface temperatures of the evaporators are equal to or lower than the set surface temperature, the defrost operation is performed in a state where the fan is operated.

11. The method of claim 10, wherein the rotating speed of the fan is inversely proportional to variations of the surface temperatures of the evaporators.

12. The method of claim 10, wherein, while the compressor is operated as it is in the second step, when the surface temperatures of the evaporators exceed the set surface temperature, the fan is stopped.

* * * * *